US005918332A

United States Patent [19]

Dees

[11] Patent Number: 5,918,332

[45] Date of Patent: Jul. 6, 1999

[54] PORTABLE HEAD REST WITH STORAGE CHAMBER

[76] Inventor: Kent L. Dees, 8385 Lake Ben Ave., San Diego, Calif. 92119

[21] Appl. No.: 08/803,889

[22] Filed: Feb. 21, 1997

Related U.S. Application Data

[63] Continuation-in-part of application No. 08/631,138, Apr. 15, 1996, abandoned.

[51] Int. Cl.[6] ..... A47C 20/02

[52] U.S. Cl. ..... 5/639; 5/931; 383/4

[58] Field of Search ..... 5/639, 636, 931; 190/2; 220/903; 383/4, 110

[56] References Cited

U.S. PATENT DOCUMENTS

| | | | |
|---|---|---|---|
| 1,542,561 | 6/1925 | Laskin . | |
| 2,289,254 | 7/1942 | Eagles | 383/110 |
| 2,962,731 | 12/1960 | Bounds | 5/639 |
| 3,290,703 | 12/1966 | Worrall . | |
| 3,538,508 | 11/1970 | Young . | |
| 4,227,961 | 10/1980 | Masch . | |
| 4,277,859 | 7/1981 | Seaman . | |
| 4,298,103 | 11/1981 | De Fries | 383/110 |
| 4,956,886 | 9/1990 | Sarkozi . | |
| 5,313,678 | 5/1994 | Redewill . | |
| 5,344,437 | 9/1994 | Pistay | 5/639 |

FOREIGN PATENT DOCUMENTS

| | | | |
|---|---|---|---|
| 649918 | 7/1969 | Canada . | |
| 999217 | 7/1965 | United Kingdom | 5/639 |

OTHER PUBLICATIONS

"Bath Massage Pillow" advertisement from Glendale Assosiates, 1986.

*Primary Examiner*—Flemming Saether
*Attorney, Agent, or Firm*—John L. Rogitz

[57] ABSTRACT

A recreation pillow includes a resilient foam rubber pillow having an elliptical shape. A slit is formed in the pillow, and the slit extends inwardly from the surface. The slit defines opposed walls that are normally juxtaposed, with the pillow being deformable such that the walls are distanced from each other and small items such as room keys can be placed between the walls. When the pillow is released, the items are held between the walls. The pillow is enclosed in a waterproof sleeve, and is ideal for beach use for both lying on and for carrying small items. Alternatively, the pillow can be hollow and can be made of relatively hard plastic or rubber.

6 Claims, 4 Drawing Sheets

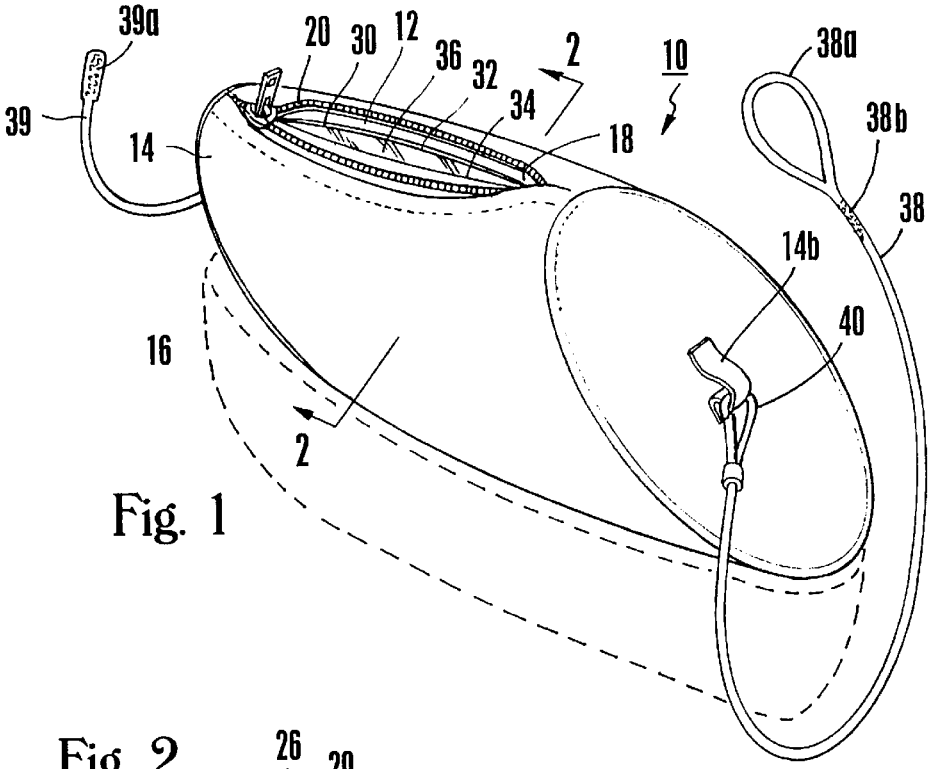
Fig. 1
Fig. 2
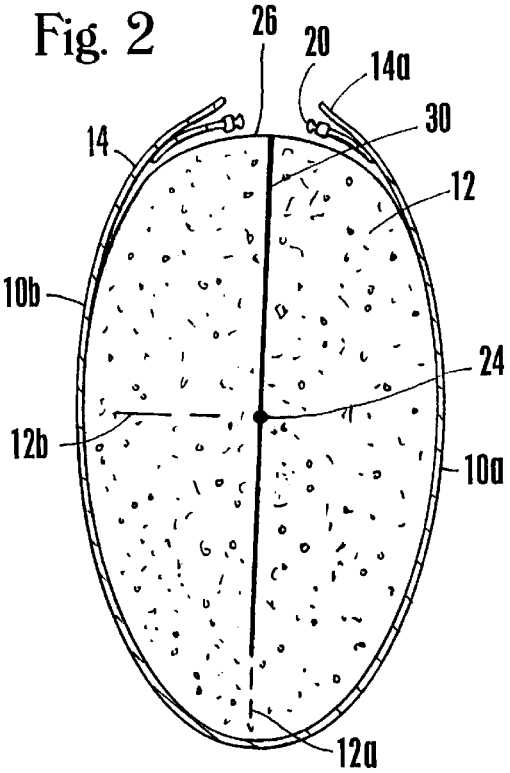
Fig. 3
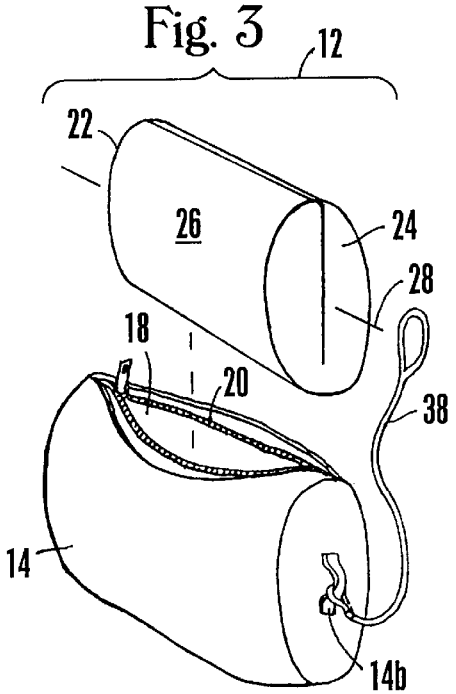

Fig. 4
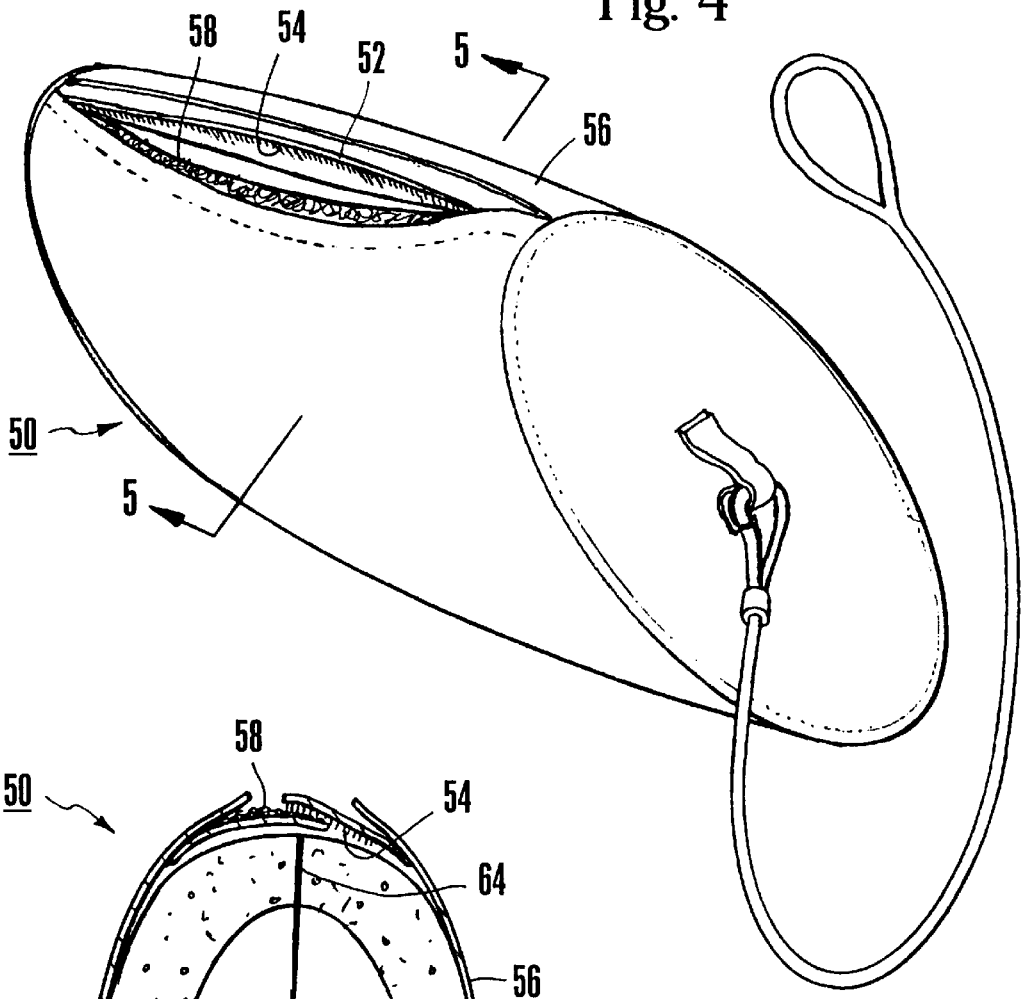
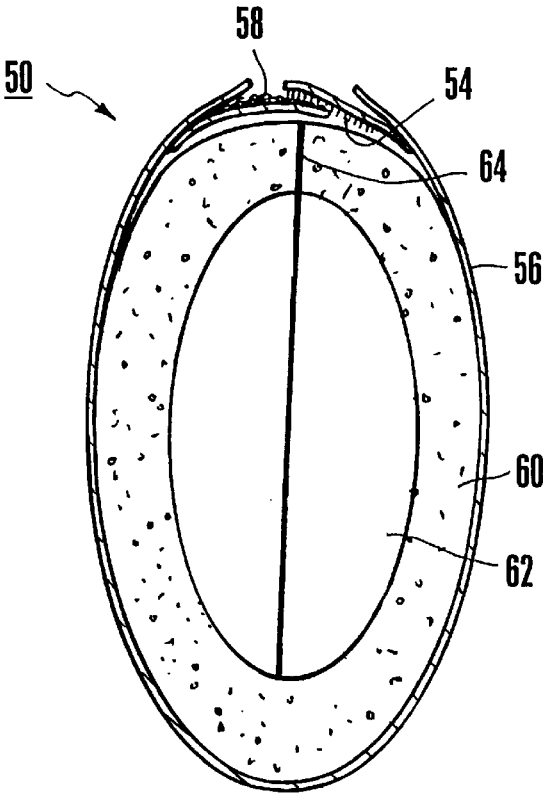
Fig. 5
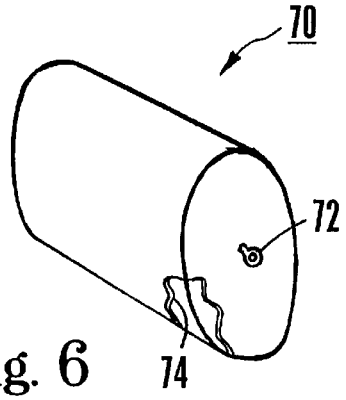
Fig. 6

PORTABLE HEAD REST WITH STORAGE CHAMBER

RELATED APPLICATIONS

The present application is a continuation-in-part of my co-pending U.S. patent application Ser. No. 08/631,138 filed Apr. 15, 1996 and now abandoned for an invention entitled "PORTABLE HEAD REST WITH STORAGE CHAMBER", incorporated herein by reference.

FIELD OF THE INVENTION

The present invention relates generally to recreation accessories, and more particularly to body support devices for recreational outings.

BACKGROUND

Many recreational activities involve outings to beaches and other pleasant locations, where people can picnic, play, and rest on the ground or on lounge chairs, recliners, and the like. In particular, many people enjoy a day at the beach, lying on the sand in the sun. For many people, it is comfortable to place a padded item such as a rolled-up beach towel or pillow under their necks for support as they lie supine on the beach or as they lie on a lounge chair or recliner.

Other accessories for outings may also be required, including small bags or other containers for keys, wallets, sunglasses, sunscreen containers, and other small but necessary items. It will readily be appreciated that it is often desirable to minimize the amount of goods that must be transported during, e.g., beach outings. Indeed, for many people who vacation near a beach at a resort, often the only items that are required to be carried to the beach are body support items such as beach towels and beach chairs, along with room or car keys and perhaps a small wallet, sunglasses, or sunscreen container. As recognized by the present invention, it would be advantageous to integrate the function of one basic accessory, namely, a head or neck support, with the function of a second basic accessory, namely, a container for small items, to thereby consolidate the functions in one convenient, easily transportable package.

Accordingly, it is an object of the present invention to provide a portable head rest which comfortably supports a person's neck and head when the person lies thereon. Another object of the present invention is to provide a portable head rest which can be used to carry small items such as keys, wallets, and the like. Still another object of the present invention is to provide a portable head rest that is easy to use and cost-effective.

SUMMARY OF THE INVENTION

A portable head rest includes a deformable pillow that defines opposed ends and a curved resting surface extending therebetween. The pillow defines a central longitudinal axis that extends between the ends and that is oriented generally parallel to the resting surface. Preferably, the pillow is formed from a unitary material having a passageway extending from the resting surface toward the central axis to permit an item to be disposed in the pillow.

Preferably, an outer sleeve formed with an opening receives the pillow therethrough. Advantageously, the sleeve includes a closure element for selectively closing the opening. In accordance with the present invention, the passageway defines opposed walls, and the pillow is deformable to an open configuration, wherein the walls are distanced from each other to expose a storage chamber, and wherein the pillow is biased to a closed configuration, wherein the walls are closely juxtaposed to each other.

In one embodiment, the pillow is made of a substantially continuous soft material except for the passageway. In this embodiment, the chamber has substantially no volume when the pillow is in the closed configuration. In an alternate embodiment, however, the pillow is made of a slightly compressible material and defines a central chamber that defines a substantially constant volume in both the open and closed configurations.

In either embodiment, the pillow defines an elliptical transverse cross-section defining a minor axis. Per the present invention, the passageway is perpendicular to the minor axis of the pillow. If desired, a cord can be connected to the sleeve.

In another aspect of the present invention, a portable device is disclosed for carrying items and for supporting a supine or reclining person's neck. In accordance with the disclosure below, the portable device includes a soft resilient pillow defining a curved surface and having an ovular or catenary-shaped cross-sectional shape for supporting a person's neck when the person lies supinely on the pillow. Per the present invention, the pillow is made of a volumetrically continuous piece of material except for a passageway that extends from the surface of the pillow inwardly therefrom. Thereby, a chamber for holding items is established. The pillow is biased to a closed configuration, wherein the chamber has substantially no volume, and is deformable to an open configuration, wherein the chamber defines a volume.

In yet another aspect, a method for supporting the neck of a supine person while storing small items includes providing a resilient pillow made of a foam material. The foam material is volumetrically continuous except for a passageway formed therein, with the passageway defining a chamber for receiving items therein. The method further includes disposing the pillow in a waterproof sleeve.

In still another aspect, a portable device for carrying items and for supporting a person's neck includes a resilient pillow. The pillow defines a curved surface and has an elliptical cross-sectional shape defining a minor axis, for comfortably supporting a person's neck when the person lies supinely or reclines on the pillow. In this aspect, the pillow is made of a slightly compressible material and is formed with a central chamber for holding items therein. Further, the pillow is formed with a passageway extending from the surface of the pillow to the chamber and oriented perpendicularly to the minor axis. The pillow is biased to a closed configuration, wherein the passageway is closed and the chamber is not exposed. Also, the pillow is deformable to an open configuration, wherein the passageway is open and the chamber is exposed.

In another aspect, an elliptically-shaped, continuously solid pillow has a plastic coating sprayed thereon and an eyelet embedded therein for attachment to a cord.

In an alternate embodiment, a portable head rest includes a deformable pillow which defines an elliptical transverse cross-section defining a semi-major axis. Per this embodiment, the pillow is formed from resilient material defining a central chamber and a passageway extending from the surface of the pillow into the chamber, with the passageway defining an oblique angle relative to the semi-major axis.

Preferably, an outer sleeve is formed with an opening substantially the length of the sleeve for receiving the pillow therethrough. A closure selectively closes the opening in the sleeve, and a flap on the sleeve extends substantially the length of the sleeve, with the flap covering the closure.

In another embodiment of the present invention, a portable head rest includes a resilient pillow defining an outer surface and a sleeve holding the pillow, the sleeve alone defining a pouch juxtaposed with the outer surface of the pillow.

The details of the present invention, both as to its structure and operation, can best be understood in reference to the accompanying drawings, in which like reference numerals refer to like parts, and in which:

BRIEF DESCRIPTION OF THE DRAWINGS

FIG. 1 is a perspective view of the portable head rest of the present invention, shown in the open configuration, with portions shown in phantom;

FIG. 2 is a cross-sectional view as would be seen along the line 2—2 in FIG. 1, with the pillow in the closed configuration;

FIG. 3 is an exploded perspective view of the pillow with waterproof sleeve;

FIG. 4 is a perspective view of an alternate embodiment incorporating a pillow having a chamber formed therein and a Velcro® closure;

FIG. 5 is a cross-sectional view as seen along the line 5—5 in FIG. 4;

FIG. 6 is a perspective view of still another embodiment, showing a continuously solid plastic-coated pillow;

DETAILED DESCRIPTION OF THE PREFERRED EMBODIMENT

Figure 7:
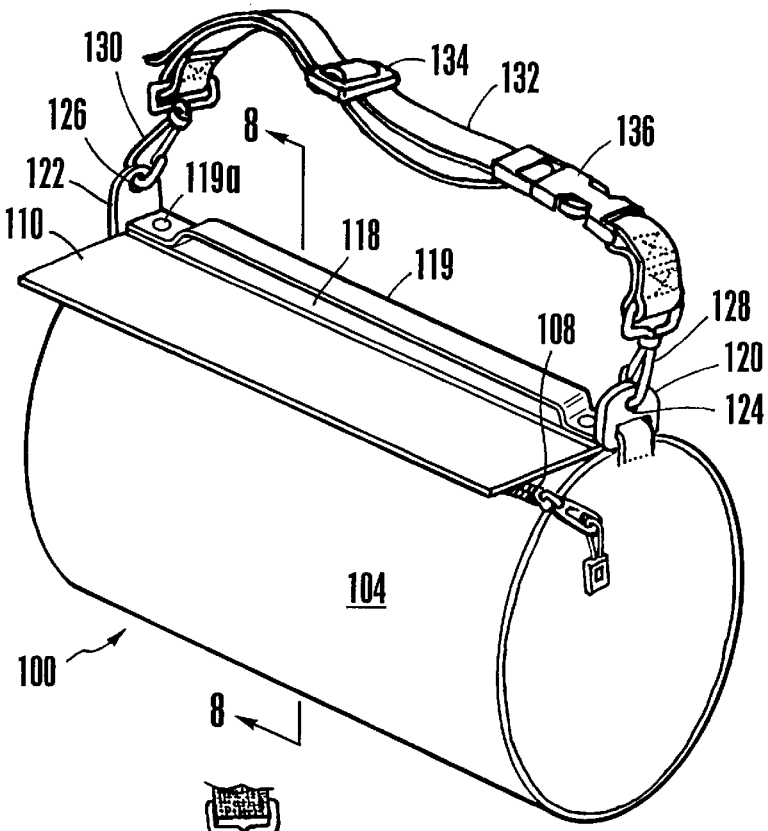
FIG. 7 is a perspective view of another embodiment of the present pillow.

Cross-referencing FIGS. 1 and 2, a portable head rest is shown, generally designated 10. As shown in, e.g., FIG. 1, the head rest 10 includes a resilient, soft, preferably foam rubber pillow 12 that is received in a waterproof sleeve 14. The sleeve 14 can be made of nylon or ballistic nylon, and is shaped complementarily to the pillow 12 for closely receiving the pillow 12 therein. In the preferred embodiment, the sleeve 14 is made of a material marketed under the trade name Hydrotie by Hydro Gear Active Wear. Alternatively, the sleeve 14 may not be completely waterproof, and may be made of vinyl-backed canvas. If desired, the waterproof sleeve 14 can in turn be received in a "wet" sleeve 16 (shown in phantom in FIG. 1), so-called because the wet sleeve 16 can be moistened to retain water on a hot day. In any case, the pillow 12 can be manually removed from the sleeve 14, and the sleeve 14 used as a stuff-bag, if desired.

It can be appreciated in reference to FIG. 1 that an opening 18 is formed in the waterproof sleeve 14 for receiving the pillow 12 therethrough. The waterproof sleeve 14 includes a closure element 20, for example a zipper as shown, for selectively closing the opening 18.

FIG. 3 best shows that the pillow 12 defines opposed ends 22, 24 and a curved resting surface 26 extending between the ends 22, 24. As can be appreciated in reference to FIG. 3, the pillow 12 defines a central longitudinal axis 28 that extends between the ends 22, 24 and that is oriented generally parallel to the resting surface 26. I have found that the pillow 12 most effectively supports the neck of a person lying supine on the pillow 12 when the pillow 12 defines an elliptical transverse cross-section as shown. Alternatively, the transverse cross-section can be a variation of elliptical, e.g., the transverse cross-section of the pillow 12 can be catenary-shaped. In the embodiment shown, the ends 22, 24 of the pillow 12 are oriented transversely to the axis 28 and are shaped as ellipses.

As best shown in FIG. 2, the pillow 12 is formed from a unitary, substantially volumetrically continuous soft material, except for a slit 30 that is formed in the pillow 12. As shown, when the pillow 12 is properly received in the waterproof sleeve 14, the slit 30 is juxtaposed with the opening 18 of the sleeve 14 and hence is exposed when the closure element 20 exposes the opening 18.

In accordance with the present invention, the slit 30 extends from the resting surface 26 toward the center of the pillow 12. As can be appreciated readily in reference to FIG. 2, the slit 30 is substantially colinear with the major axis 12*a* of the elliptical pillow 12, and the slit 30 extends from one end of the major axis 12*a* past the center axis 28 toward the opposite end of the major axis 12*a*, stopping short of the opposite end of the major axis 12*a*. Consequently, the slit 30 is perpendicular to the minor axis 12*b* of the elliptical pillow 12.

It may now be appreciated that with the above-disclosed combination of structure, a person would ordinarily orient the pillow 12 with the major axis 12*a* oriented horizontally and the minor axis 12*b* oriented vertically. It may be further appreciated that, owing to the advantageous combination of structure described above, the person consequently would not lay on the slit 30 (and, hence, would not lay on the potentially uncomfortable closure element 20), but rather would lay on one or the other of two continuous, uninterrupted major surfaces 10*a*, 10*b* of the head rest 10. Further, by orienting the slit 30 and closure element 20 as shown, the closure element 20 does not face the ground when a person lies on the head rest 10. Consequently, the likelihood of fouling the closure element 20 is reduced. As intended by the present invention, a major surface of an object having an elliptical transverse cross-section is the surface which, at its centerpoint, is perpendicular to the minor axis of the cross-section.

Per the present invention, the resilient pillow 12 is materially biased to a closed configuration shown in FIGS. 2 and 3. The pillow 12, however, can be deformed to an open configuration shown in FIG. 1. One way to deform the pillow 12 to the open configuration is to urge inwardly against both ends 22, 24 of the pillow 12 simultaneously.

FIG. 1 best shows that the slit 30 defines opposed walls 32, 34 that in turn define a storage chamber 36 therebetween. In the open configuration shown in FIG. 1, the walls 32, 34 are distanced from each other. Consequently, the chamber 36 defines a volume. On the other hand, in the closed configuration shown in FIGS. 2 and 3, the walls 32, 34 are closely juxtaposed to each other, such that the chamber 36 defines substantially no volume.

It can now be appreciated that the closure element 20 can be manipulated as appropriate to expose the opening 18 of the waterproof sleeve 14, and the pillow 12 advanced into the sleeve 14. Further, the pillow 12 can be deformed to the open configuration, and small items such as keys, credit cards, cash, and the like disposed in the chamber 36. Then, the pillow 12 can be released to move back to the closed configuration and to hold the items between the walls 32, 34. The closure element 20 is next manipulated as appropriate to close the opening 18 and thereby retain the items in the pillow 12. Additionally, the items are retained in the pillow 12 owing to relatively high coefficient of friction between the items and the walls 32, 34.

If desired, the waterproof sleeve 14 can be formed with a flap 14*a* (FIG. 2) to cover the closure element 20. Thereby, fouling of the closure element 20 by sand and other debris is reduced. Additionally, the waterproof sleeve 14 can include a fabric loop 14*b* that is sewn onto or otherwise attached to the sleeve 14. A plastic cord 38 having a grasping loop 38*a* includes a plastic shackle clip 40 that can be manipulated in accordance with principles well-known in the art to releasably connect the cord 38 to the loop 14*b* of the waterproof sleeve 14. If desired, a second cord 39 having a Velcro® loop layer 39*a* can be attached to the sleeve 14 opposite the cord 38, and the layer 39*a* engaged with a Velcro® hook layer 38*b* to facilitate connecting the cords together around the waist of a person in a so-called "fanny pack" carrying configuration. To this end, either one or both of the cords 38, 39 can be configured as selectively adjustable straps.

Now referring to FIGS. 4 and 5, a head rest is shown, generally designated 50. As shown, the head rest 50 is in all substantial respects identical in construction and operation to the head rest 10 shown above, except for the below-noted differences.

As shown in FIGS. 4 and 5, the head rest 50 includes a closure element 52 which is made of Velcro®. Accordingly, a strip 54 of Velcro hooks is attached to a sleeve 56 of the head rest 50, while a strip 58 of Velcro eyes is attached to the sleeve 56 on the side of the sleeve 56 opposite to the side on which the strip 54 of Velcro hooks is attached.

Furthermore, the head rest 50 includes a pillow 60 having an elliptical cross-sectional shape. Unlike the pillow 12 described formerly, however, the pillow 60 shown in FIGS. 4 and 5 is not soft, and can be only slightly compressed when a person lies on it. Preferably, the pillow 60 is made of slightly compressible, resilient plastic or rubber. Moreover, the pillow 60 is hollow, and defines a permanent central chamber 62 in which sunglasses, sunscreen containers, etc. can be disposed. The chamber 62 is permanent in that it defines a substantially constant volume regardless of whether it is in the open or closed configuration. Like the pillow 12 shown in FIGS. 1 and 2, the pillow 60 includes a slit 64 that can be opened to expose the chamber 62, with the slit 64 and closure element 52 being oriented along a major axis of the ellipse formed by the pillow 60 for reasons set forth above.

FIG. 6 shows a pillow, generally designated 70, that has no slit, chamber, or sleeve, but instead is made, as by molding, into a continuous elliptically-shaped foam or rubber pillow 70. An eyelet 72 can be embedded in the pillow 70 by means well-known in the art for attaching to a cord 38 (FIG. 1). Also, a plastic coating 74 is deposited onto the pillow 70 as by spraying. It is to be understood that while the pillows 12, 60, 70 described herein can be made of molded plastic or rubber, alternatively any one of the pillows 12, 60, 70 can be configured as air-inflatable plastic skins.

Figure 8:
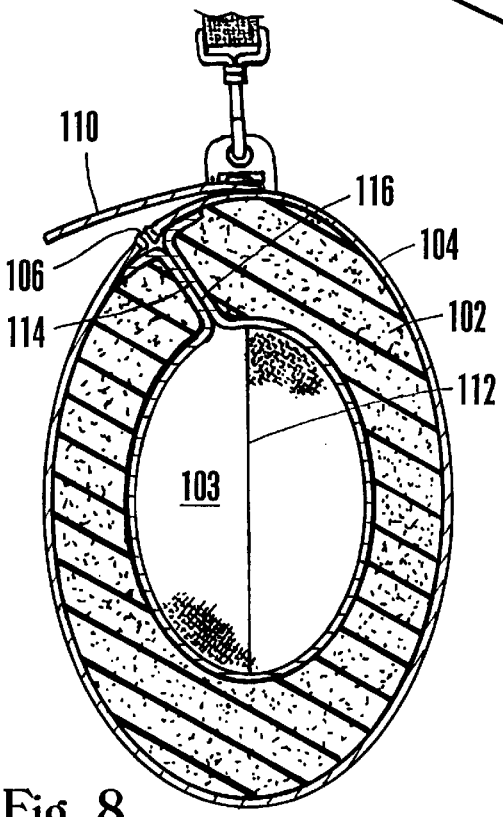
FIG. 8 is a cross-sectional view as seen along the line 8—8 in FIG. 7.

FIGS. 7 and 8 show a head rest 100 including a hollow resilient elliptically-shaped foam rubber pillow 102 that defines a chamber 103 and that is covered a nylon sleeve 104, preferably made of Hydrotie by Hydro Gear Active Wear. The sleeve 104 has an opening 106 which is selectively closable by a closure element such as a zipper 108. As shown in FIGS. 7 and 8, the opening 106 and zipper 108 are covered by a flap 110 that is attached to the sleeve 104, to thereby reduce the likelihood that debris such as sand will foul the zipper 108. With this structure, the pillow 102 can be received in the sleeve 104 through the opening 106.

FIG. 8 best shows that the pillow 102 defines a semi-major axis 112, and a passageway, such as a slit 114, is formed radially in the pillow 102 at an oblique angle relative to the semi-major axis 112. If desired, a nylon liner 116 is disposed in and conforms to the slit 114 and the sides of the chamber 103. Per the present invention, the sleeve 104 is configured such that the opening 106 is juxtaposed with the slit 114.

Referring back to FIG. 7, an attachment strip 118 is sewn on to or otherwise attached to the sleeve 104, and the strip 118 extends the length of the head rest 100. A fabric loop handle 119 is fixedly attached to the strip 118 at one end thereof and selectively attached to the strip 118 at the opposite end thereof by means of a snap 119*a*. Thus, the loop handle 119 can be unsnapped from the strip, and a person can grasp the handle 119, with the handle 119 remaining attached to the strip 118 at the end opposite the snap 119*a*.

Strap attachment elements 120, 122 are provided, with a first element 120 being formed with an opening for receiving the strip 118 therethrough and the second element 122 being attached to the strip 118 or to the sleeve 104, to hold the elements 120, 122 onto the head rest 100. Moreover, the elements 120, 122 are formed with upper apertures 124, 126, and plastic or metal clips 128, 130 can be selectively engaged with the respective apertures 124, 126. In turn, the clips 128, 130 are attached to an adjustable length carrying strap 132 as shown. In the preferred embodiment, the carrying strap 132 includes a buckle 134 for adjusting the length of the strap 132. Also, the strap 132 includes a connector clip 136 for selectively detaching one segment of the strap 132 from another.

Figure 9:
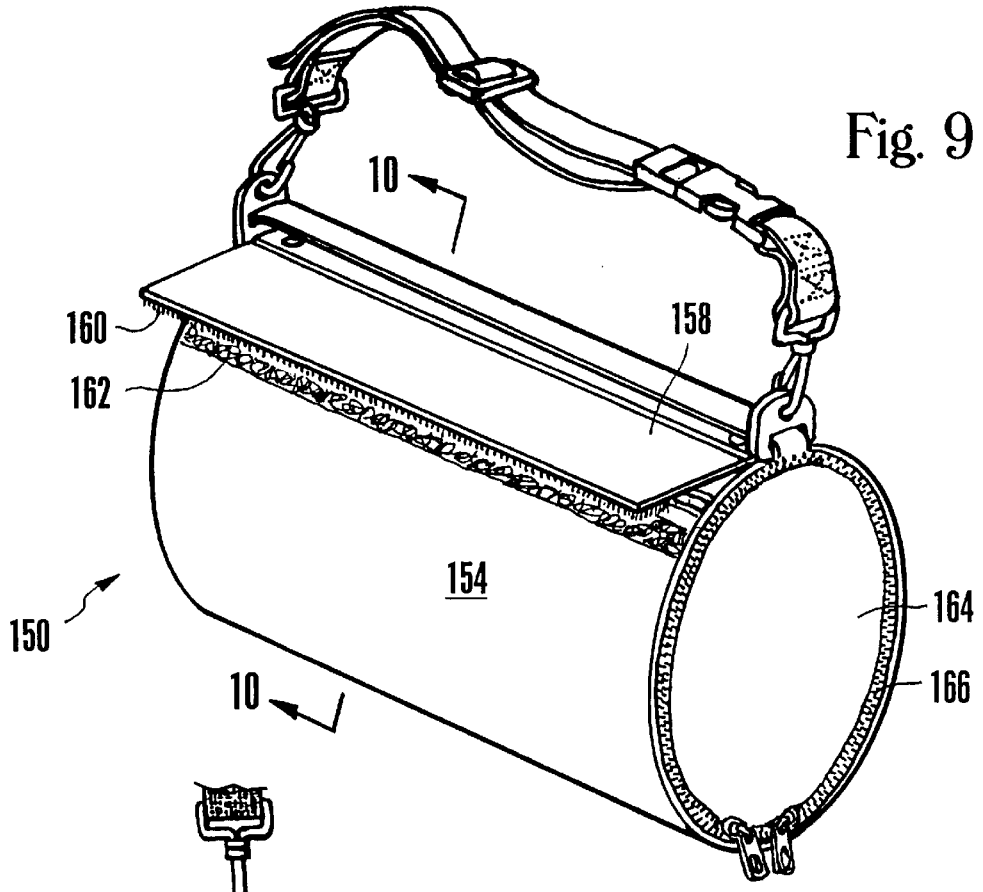
FIG. 9 is a perspective view of another embodiment of the present pillow.
Figure 10:
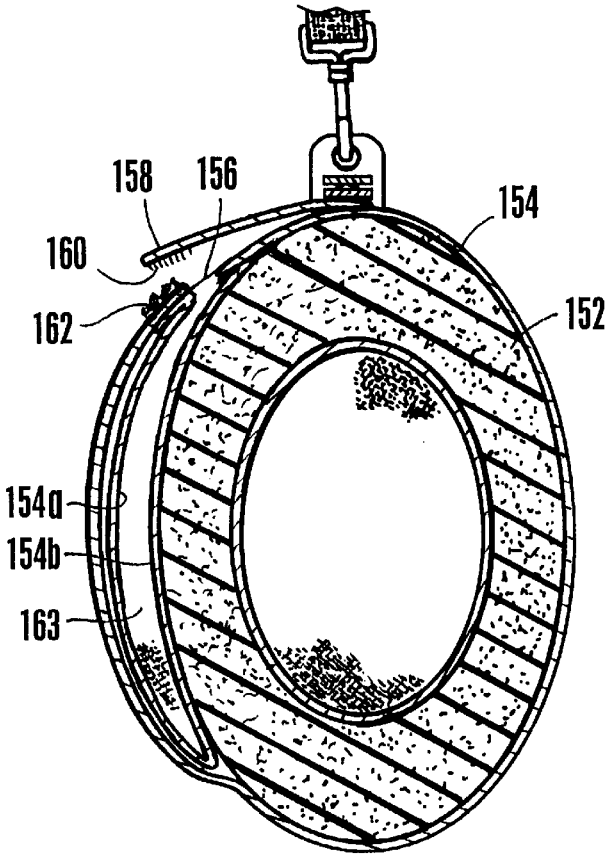
FIG. 10 is a cross-sectional view as seen along the line 10—10 in FIG. 9.

Now referring to FIGS. 9 and 10, a head rest 150 is shown that is in all substantial respects identical to the head rest 100 shown in FIGS. 7 and 8, with the following exceptions. The head rest 150 shown in FIGS. 9 and 10 includes a hollow but slitless pillow 152. A sleeve 154 encloses the pillow 152, and the sleeve 154 includes an opening 156 and a flap 158 that covers the opening 156 and that includes a strip 160 of Velcro® hook material for detachably engaging a strip 162 of Velcro® eye material as shown. As shown, the opening 156 communicates with a pouch 163 that is established between a doubled back layer 154*a* of the sleeve 154 and a surface portion 154*b* of the sleeve 154. Items can be carried in the pouch 163. Thus, the pouch 163 is defined by the sleeve 154 alone, in that the no wall of the pouch 163 is established by the pillow 152.

Furthermore, the sleeve 154 includes an elliptically-shaped end 164 for covering a respective end of the pillow 152. The end 164 of the sleeve 154 is selectively detachable from the rest of the sleeve 154 by means of a closure such as a zipper 166. Accordingly, access to the hollow interior of the pillow 152 can be established by unfastening the zipper 166. The pillow 152 is received in the sleeve 154 through the end 164. As stated above, the pillow 152 does not contain a slit. This feature has the benefit of the pillow 152 not inadvertently deforming.

Figure 8A:
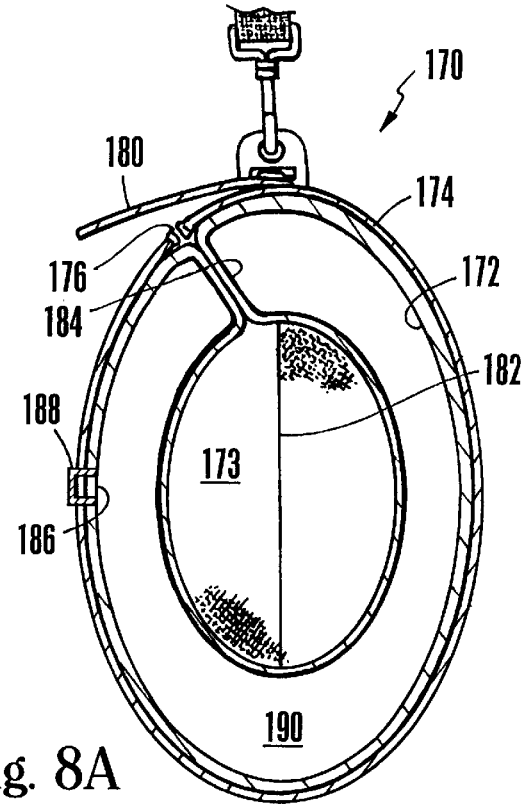
FIG. 8A is a cross-sectional view of an alternate embodiment as would be seen along the line 8—8 in FIG. 7.

FIG. 8A shows that instead of a pillow made from foam, the embodiment shown in FIGS. 7 and 8 can include an inflatable pillow. More particularly, a head rest 170 includes a hollow elliptically-shaped inflatable pillow 172 that is made from a rectangular piece of inflatable material and folded into the configuration shown to define a chamber 173. The pillow 172 is covered a nylon sleeve 174. The sleeve 174 has an opening 176 which is selectively closable by a closure element. As shown, the opening 176 is covered by a flap 180 that is attached to the sleeve 174.

Additionally, FIG. 8A shows that the pillow 172 defines a semi-major axis 182, and a passageway, such as a slit 184, is formed radially in the pillow 172 at an oblique angle relative to the semi-major axis 182. Per the present invention, the sleeve 174 is configured such that the opening 176 is juxtaposed with the slit 184.

The pillow 172 is inflatable with air; accordingly, an air pathway 186 is established by a valve 188 for selectively establishing communication between the interior 190 of the pillow 172 and the atmosphere. As shown, the valve 188 can be a valve that is conventionally used to selectively inflate and deflate beach balls and the like by manually compressing the valve 188 to cause it to open, and then blowing into the pathway 186 (to inflate the pillow 172) or simply allowing air to exhaust from the interior 190 to the atmosphere (to deflate the pillow 172). Or, the pillow 172 with valve 188 can be a self-inflatable apparatus wherein the valve 188 is manipulated to cause the pillow 172 to inflate without requiring a person to blow into the valve 188. Such a self-inflatable device is represented, e.g., by the device made by Basic Designs of Santa Rosa, Calif. and marketed under the trade name "Self Inflating Pillow".

While the particular PORTABLE HEAD REST WITH STORAGE CHAMBER as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

What is claimed is:

1. A portable head rest comprising:

a pillow defining opposed elliptical ends and at least one surface therebetween, the pillow being made of a piece of resilient material and being deformable, the pillow having a central chamber and a passageway extending from the surface of the pillow into the chamber, wherein the passageway defines opposed walls, and the pillow is deformable to an open configuration, wherein the walls are distanced from each other to expose the chamber, and wherein the pillow is materially biased to a closed configuration wherein the opposed walls are closely juxtaposed to each other; and a sleeve for holding the pillow and configured for constraining the pillow in a curved configuration, the sleeve including an outer sleeve formed with an opening juxtaposed with one of the ends for receiving the pillow therethrough and for accessing the central chamber, a sleeve end for selectively covering the opening, and a zipper for selectively engaging the sleeve end with the sleeve.

2. The portable head rest of claim 1, wherein the sleeve comprises:

an outer sleeve formed with an opening substantially the length of the sleeve for receiving the pillow therethrough;

a closure selectively closing the opening in the sleeve; and a flap on the sleeve extending substantially the length of the sleeve, the flap covering the closure.

3. A portable head rest, comprising:

a deformable pillow defining opposed ends and a curved resting surface extending therebetween, the pillow defining a semi-major axis, the pillow being formed from a unitary material formed with a passageway extending radially inwardly from the resting surface, wherein the passageway defines opposed walls, and the pillow is deformable to an open configuration, wherein the walls are distanced from each other to expose a storage chamber, and wherein the pillow is materially biased to a closed configuration wherein the opposed walls are closely juxtaposed to each other; and an outer sleeve formed with an opening substantially the length of the sleeve for receiving the pillow therethrough, the outer sleeve being formed with an opening juxtaposed with one of the ends for receiving the pillow therethrough and for accessing the central chamber, a sleeve end for covering the opening, and a closure for selectively engaging the sleeve end with the sleeve.

4. A portable device for carrying items and for supporting a supine person's neck, comprising:

a resilient pillow made of a piece of material;

a sleeve for holding the pillow in a curved configuration such that the pillow can define a central chamber for holding items, the sleeve being formed with an opening for receiving the pillow therethrough, the pillow having a passageway defining opposed walls, the passageway extending at least part way between the ends of the pillow, wherein the pillow is deformable to an open configuration, wherein the walls are distanced from each other to expose a chamber, and wherein the pillow is materially biased to a closed configuration wherein the opposed walls are closely juxtaposed to each other, the sleeve including and outer sleeve formed with an opening juxtaposed with one of the ends for receiving the pillow therethrough and for accessing the central chamber, a sleeve end for covering the opening, and a closure for selectively engaging the sleeve end with the sleeve.

5. The device of claim 4, further comprising a flap on the sleeve for covering the closure element.

6. The device of claim 5, wherein the material is foam or inflatable plastic.

* * * * *